US006602145B1

(12) United States Patent
Yeh

(10) Patent No.: US 6,602,145 B1
(45) Date of Patent: Aug. 5, 2003

(54) LASER AIMING DEVICE ON THE SHAFT OF A GOLF PUTTER

(76) Inventor: Chung-Kai Yeh, 1F, No. 26, Lane 442, Chung-Cheng Rd., Yeng Her, Taipei Hsien (TW)

( * ) Notice: Subject to any disclaimer, the term of this patent is extended or adjusted under 35 U.S.C. 154(b) by 0 days.

(21) Appl. No.: 10/119,000

(22) Filed: Apr. 10, 2002

(51) Int. Cl.[7] ..... A63B 69/36
(52) U.S. Cl. ..... 473/220; 473/219
(58) Field of Search ..... 473/220, 219, 473/221, 223, 224

(56) References Cited

U.S. PATENT DOCUMENTS 5,207,429 A * 5/1993 Walmsley et al. ..... 473/220
5,330,189 A * 7/1994 Reichow ..... 473/224
5,464,221 A * 11/1995 Carney ..... 473/220
5,464,222 A * 11/1995 Carney ..... 473/220
5,494,290 A * 2/1996 Stefanoski ..... 473/220
5,611,739 A * 3/1997 Carney ..... 473/220
5,707,296 A * 1/1998 Hodgson et al. ..... 473/220
5,725,440 A * 3/1998 Finney ..... 473/220
6,450,893 B1 * 9/2002 Primiano et al. ..... 473/220

FOREIGN PATENT DOCUMENTS

TW 388289 * 9/1988

* cited by examiner

*Primary Examiner*—Paul T. Sewell
*Assistant Examiner*—Nini F Legesse
(74) *Attorney, Agent, or Firm*—Troxell Law Office PLLC

(57) ABSTRACT

The present invention relates to an improve structure of the aiming device of a golf putter, more particularly to an improved structure of "golf putter" as disclosed in the R.O.C. Patent Publication No. 388,289 that requires less mechanical components and has simple shape and easy-to-design mold for mass production to effectively lower the manufacturing cost of the laser aiming device of the club head of a golf putter. It primarily comprises a base with a laser emitting module being coupled by a buried head screw to a bottom chassis or two bottom chassis, wherein the laser emitting module further comprising a press button being coupled to a laser emitter and a conductive plate, which are disposed in two different sized holes and a battery accommodation cavity on the same surface of the base.

2 Claims, 7 Drawing Sheets

LASER AIMING DEVICE ON THE SHAFT OF A GOLF PUTTER

BACKGROUND OF THE INVENTION

1. Field of the Invention

The present invention relates to an improve structure of the aiming device of a golf putter, more particularly to an improved structure over the "golf putter" as disclosed the R.O.C. Patent Publication No. 388,289 having the shortcomings of complicated structure, uneasy to make, and high manufacturing cost. Thus, this invention provides a laser aiming device on the club head of the golf putter which features simple structure, easy-to-assemble, fast-to-manufacture, and low manufacturing cost.

2. Description of the Related Art

As described in the U.S. Pat. No. 5,494,290, a golf club having a built-in laser component; a passing-through hole and a control button are disposed on the handle; a mirror is disposed inside and outside of the passing hole, and a circular mirror is disposed under the mirror, and a battery is disposed inside the handle. When it is in use, the user just needs to press the button, an indicating line for the vertical hitting plane is projected on the golf club for the aiming purpose. Such aiming device must be bought together with the goal club as a whole package, having a higher price but being used as a training club only. In formal tournament, the golfer has to prepare for another regular golf club, and thus may have the issue of changing golf clubs when the golfer has got used to the original one.

As disclosed in the U.S. Pat. No. 5,611,739, a putter comprises an aiming device on the club head, and the aiming device will emit an indicating line for the vertical hitting plane. Such aiming device can be sold separately, and has the advantage of easy to assemble, but it has a shortcoming that the aiming device is installed above the club head. The user will see the aiming device while using it, creating an odd visual and psychological effect and affecting the swing motion since it has added extra weight on the club head.

As disclosed in the U.S. Pat. No. 5,725,440, a putter comprises a laser pen being accommodated in a concession on the handle of the club, and a mirror is disposed at the bottom of the shaft of the putter so that the light will be reflected outward in a right angle forming an indicating line. Such structure requires the golfer to buy a brand new putter and thus carries a higher cost for such purpose.

As disclosed in the U.S. Pat. No. 5,707,296, a putter has a laser component on each side of the club head of the putter for generating two parallel indicating lines. Such structure also requires the golfer to buy a brand new putter and thus carries a higher cost for such purpose. In the actual play, the golfer has the trouble of changing the golf clubs as well.

Besides the U.S. Pat. No. 5,494,290 which discloses a way of projecting an indicating line on the ground and allowing the golfer to have a better sight, and the latter three emit one or two laser beams towards the front vertical hitting plane as the aiming line. Such aiming line is not projected on the ground, but in form of the parallel beams at a predetermined height above the ground. When the golfer is looking downward, the golfer is not able to see the indicating line clearly, especially when the light is bright during daytime.

As disclosed in the U.S. Pat. Nos. 5,464,222 and 5,464,221, a laser component is coupled to the connecting portion between the club head of the putter and the shaft of the golf club. It has the shortcomings of higher cost, changing clubs during practice, and unclear indicating lines.

The R.O.C. Patent Publication No. 388,289 entitled "Aiming device of golf putter" aims at resolving the shortcomings of the aforementioned patents, and representing the newest product for the aiming device of the golf putter. The R.O.C. patent is filed on Jul. 9, 2000, and published in the R.O.C. Patent Gazette on Apr. 21, 2000, which comprises a clipping element 20, a buckling element 30, a body 40, a fixing element 50, a laser component 60, a switch 70, and a power supply 90. In FIGS. 1 to 5, the body 40 having an upper casing 41 and a lower casing 42 being coupled by two screws 43, and a laser component 60 and a latching element 44 are embedded separately into the grooves 413, 429 formed by the two casings 41, 42; wherein the latching element 44 has a screw hole 441 at its center, and a circular concave surface 442 on its bottom. The shape of the circular concave surface 442 is corresponsive to the shape of the convex circular curved surface of the lower casing 42. A screw bolt 45 is inserted into a through hole 274 of clipping element 20, and after passing through the fixing element 50, and being secured to the screw hole 441 of the latching element 44 such that the clipping element 20, fixing element 50, and the lower casing 44 are coupled together as an integral part. Then, two screw bolts 43 are passed through the recession 421 of the lower casing 42 and through the through hole 422 to the axial hole 412 of the upper casing 41. The battery box is embedded into the preset accommodation cavity 401 of the body 40, and a switch 70 and a touch control button 80 is coupled to a printed circuit board 46. When it is in use, the C-shaped clipper of the clipping element 20 is clipped to the shaft 10 of the golf club or the handle 15, and then a latching element 30 will secure the clipping element 20 in a fixed position. Such structure definitely can improve the shortcomings as described in the previous U.S. patents and attain the purpose of assisting the golfer to aim at the target. However, as we know from the above, these components include clipping element, latching element, body, fixing element, and it has to be mounted to the lower casing of the body by screws in order to combine the upper casing and the lower casing as a whole. Secondly, the coupling relation between the witch, power supply, and laser components makes the assembling more complicated and difficult, and thus having the shortcoming of high cost.

In view of the above description about the prior art such as the R.O.C. Publication No. 388,289 still having the aforementioned shortcomings, the present inventor herein with many years of practical experience in the design, development, manufacturing and marketing of laser component and its accessories (such as the laser pen, etc.) enhances the design of the laser aiming device on the club head of a golf putter by performing a series of researches and developments and finally succeeds to invent the present invention, which is submitted to the Patent and Trademark Office for review and granting of the commensurate patent rights.

SUMMARY OF THE INVENTION

The primary objective of the present invention is to provide a laser aiming device on the club head of the golf putter, which comprises a base having a laser emitting module that is coupled to one or two bottom casings by a plurality of buried head screws, wherein the laser emitting module further comprising a laser emitter being coupled to an ON/OFF switch and a conductive plate, which are disposed in two different sized holes and a battery accommodation cavity on the same surface of the base by means of the features of its shape. In addition, a preset groove on the base is latched to the shaft of the golf putter, and a plurality of the buried screws pass through the trapezoid hole and is fixed to the screw hole on the base such that the base, golf putter, and bottom chassis are fixed together as a whole. When it is in use, the golfer just need to press the switch gently to set up the aiming device by the projection of laser beam and attain the expected effect of assisting the putter to aim at the target. It has simpler components such that the whole structure is simplified, and the mold for mass production is made easier in order to reduce the manufacturing cost. It can improve the complicated structure, difficulty of making mold, and high cost for the traditional aiming device of the golf putter.

To make it easier for our examiner to understand the objective of the invention, its structure, innovative features, and its performance, we use a preferred embodiment together with the attached drawings for the detailed description of the invention.

BRIEF DESCRIPTION OF THE DRAWINGS

Other objects, features, and advantages of the invention will become apparent from the following detailed description of the preferred but non-limiting embodiment. The description is made with reference to the accompanying drawings, in which.

DETAILED DESCRIPTION OF THE PREFERRED EMBODIMENTS

Figure 1:
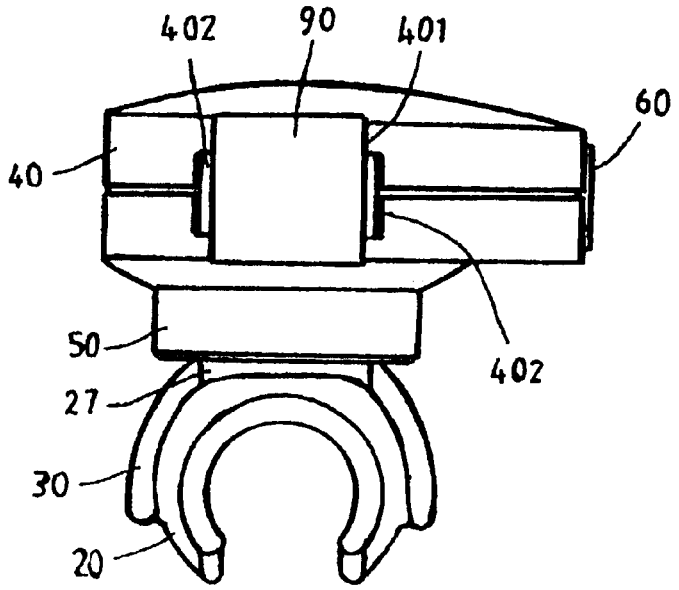
FIG. 1 shows the rear view of the "Aiming device of a golf putter" as disclosed in the R.O.C. Patent Publication No. 388,289.
Figure 4:
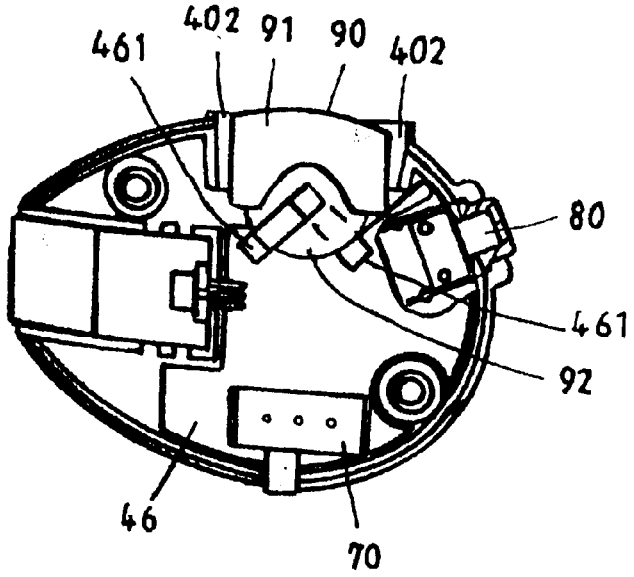
FIG. 4 shows the down view of the partial cross-sectional diagram of the "Aiming device of a golf putter" as disclosed in the R.O.C. Patent Publication No. 388,289.
Figure 2:
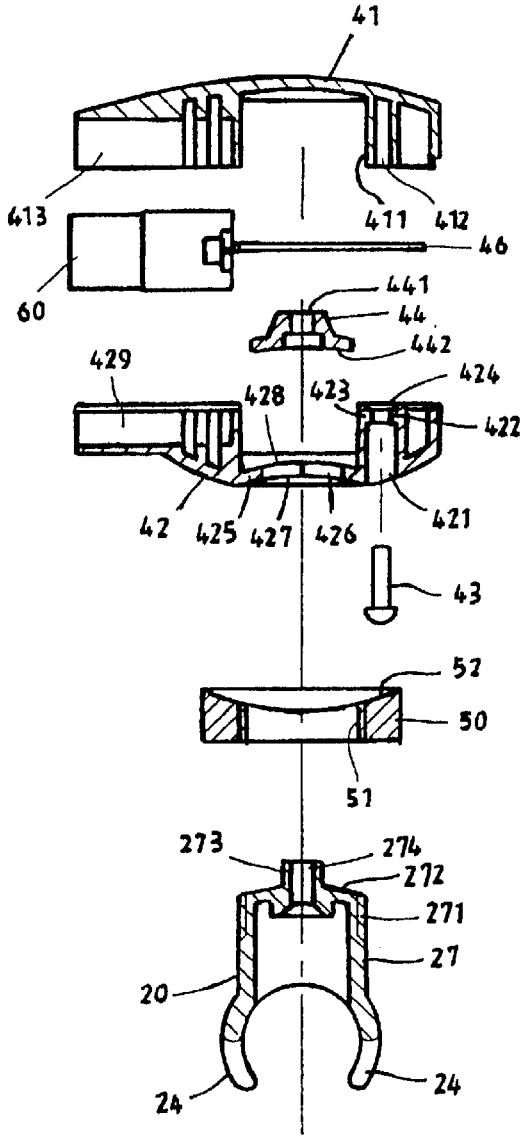
FIG. 2 shows the explosive diagram of the clipping element, the fixing elements of the body (upper and lower casings), and the laser components according to the "Aiming device of a golf putter" as disclosed in the R.O.C. Patent Publication No. 388,289.
Figure 3:
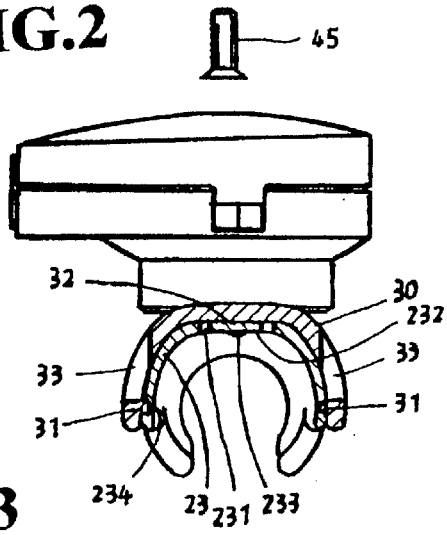
FIG. 3 shows the front view of the partial cross-sectional diagram of the "Aiming device of a golf putter" as disclosed in the R.O.C. Patent Publication No. 388,289.
Figure 5:
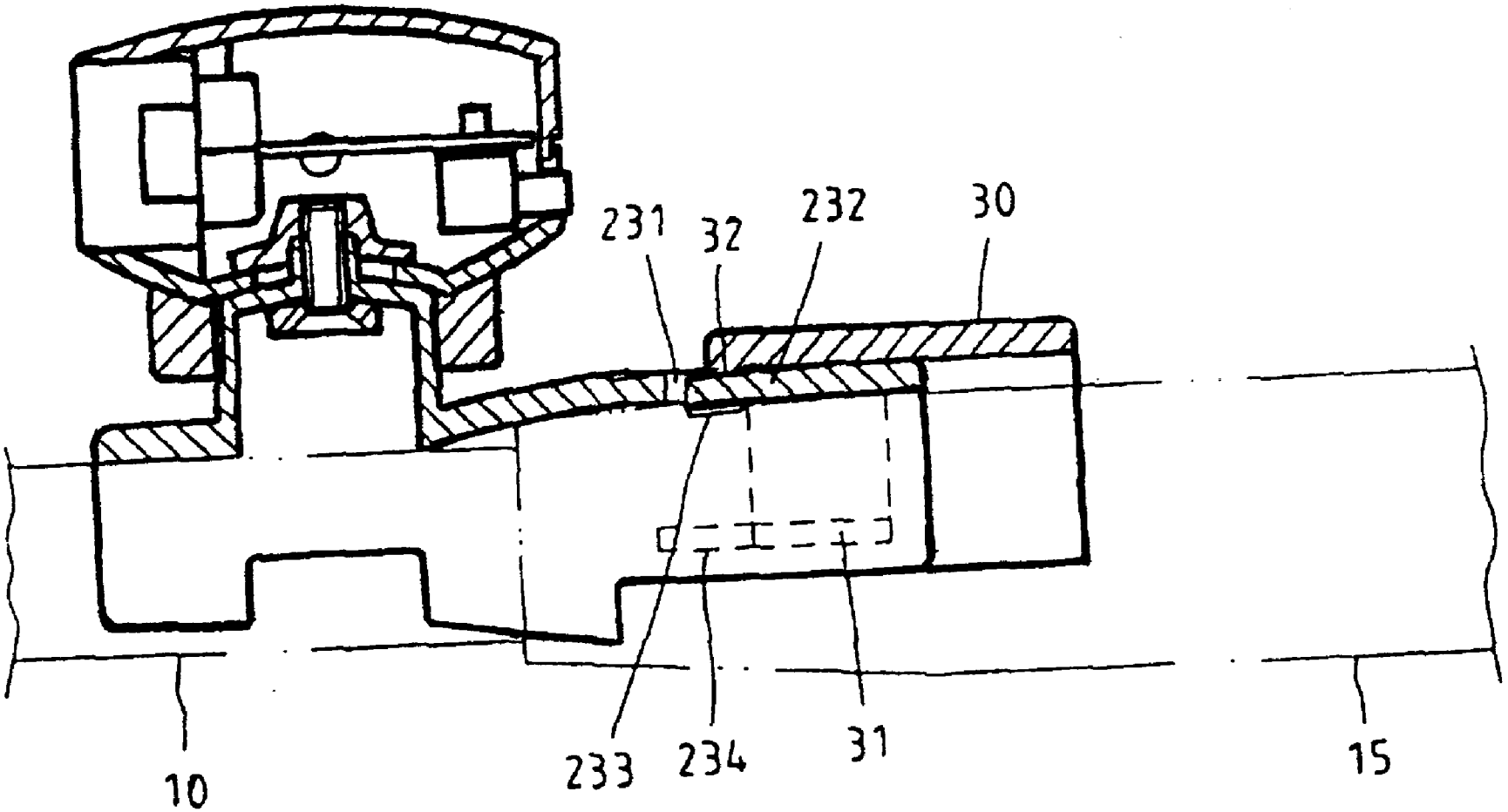
FIG. 5 shows the cross-sectional diagram of the front view of the partial cross-sectional diagram of the "Aiming device of a golf putter" as disclosed in the R.O.C. Patent Publication No. 388,289 when it is in use.
Figure 6:
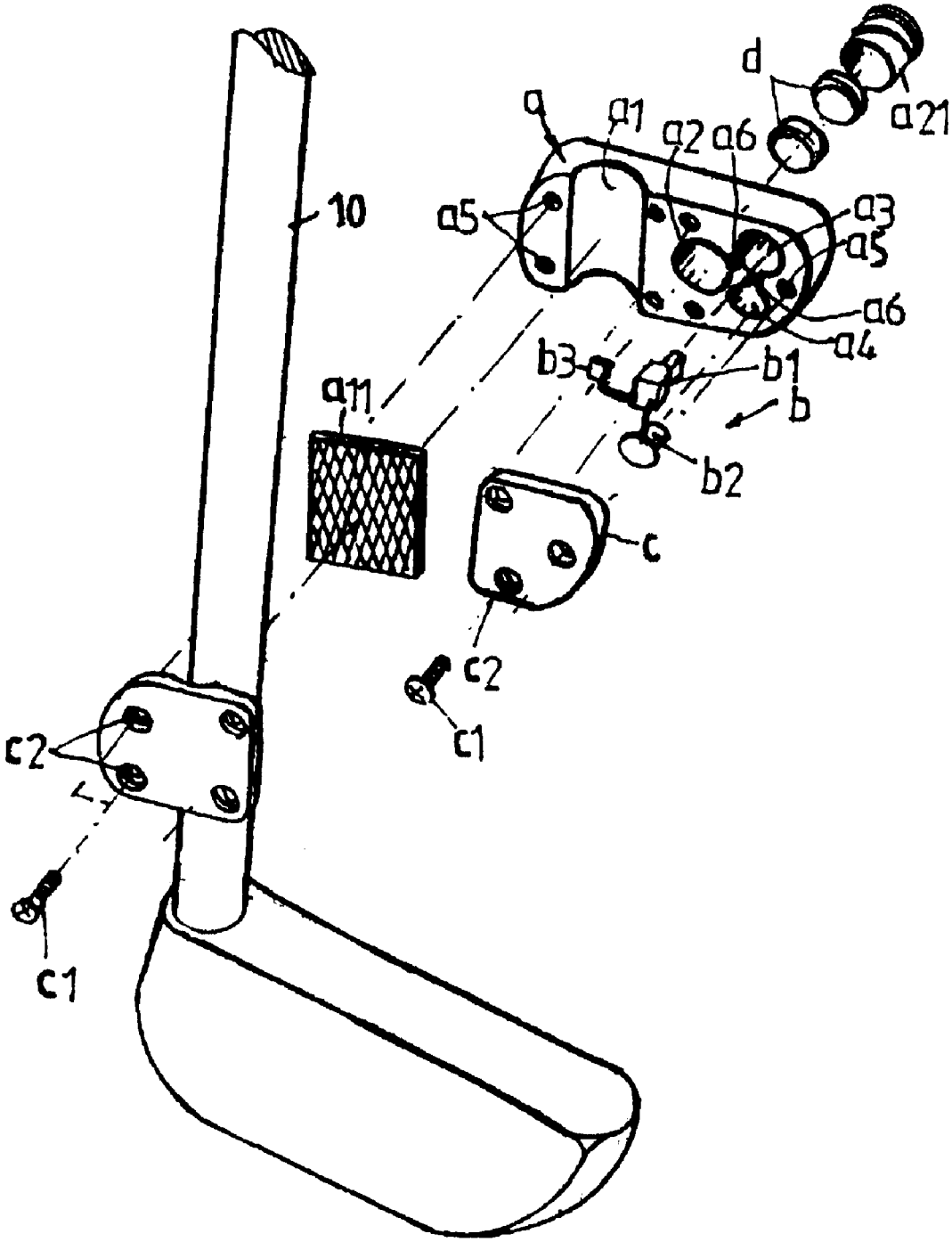
FIG. 6 shows the explosive diagram of the present invention.
Figure 7:
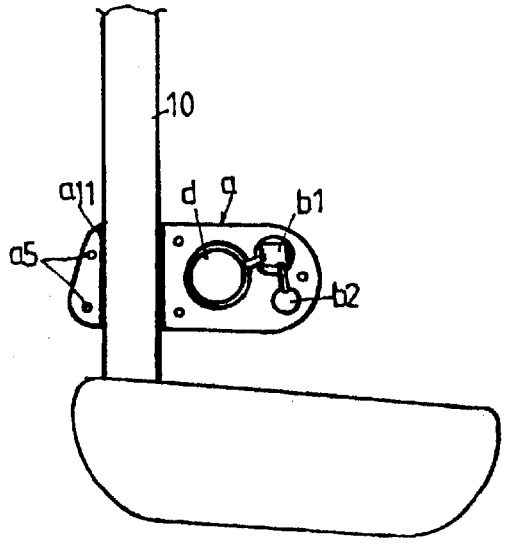
FIG. 7 shows the planar diagram of the assembly of the present invention.
Figure 8:
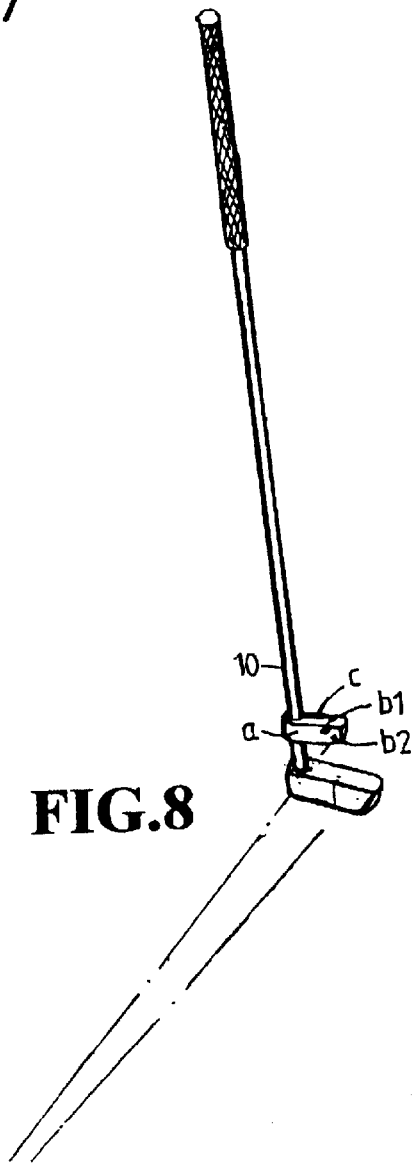
FIG. 8 shows the illustrative diagram of the preferred embodiment of the present invention.

Please refer to FIGS. 6 to 8 for the explosive diagram, the planar diagram of the assembly, and the illustrative diagram. In the figures, it shows that the present invention comprises a base (a) further comprising a laser emitting module (b) which is mounted to one bottom casing (c) or two bottom casings (c) by a plurality of buried head screws (c1), wherein the laser emitting module (b) further comprising a laser emitter (b2) being coupled to an ON/OFF switch (b1) and a conductive plate (b3), and the base (a) is integrally pressed or shaped as a whole. On the same side, there are a groove (a1) with substantially equal to the external diameter of the golf putter, a battery accommodation cavity (a2), an accommodation switch (b1), two different sized holes (a3, a4) and a plurality of screw holes (a5) wherein the battery accommodation cavity (a2) and the two different sized holes (a3, a4) are coupled to a groove (a6) for being used by the wires of the accommodation switch (b1) and the laser emitter (b2). A trapezoid hole (c2) is disposed on the back of the bottom casing (c) corresponsive to the screw hole (a5) of the base (a). When it is assembled, the conductive plate (b3) of the laser emitting module (b) is placed into the battery accommodation cavity (a2) and the ON/OFF switch (b1) and laser emitter (b2) into the two different sized holes (a3, a4) respectively according to the sequence of their sizes. In the meantime, place two pieces of mercury batteries (d) into the battery accommodation cavity (a2), and a battery cover is used to seal the opening at the front side of the battery accommodation cavity (a2) in order to fix the mercury battery into the shaft (10) of the golf club or use the groove (a1) to sheath a rubber washer (a11) onto the putter (10) and then buried head screw (c1) is used for the mounting by passing it through the trapezoid hole (c2) and the screw hole (a5) such that the bottom casing (c), the golf putter (10), and the base (1) are securely coupled together as a whole. As shown in FIG. 8, it forms the aiming device on the club head of the golf putter.

Figure 9:
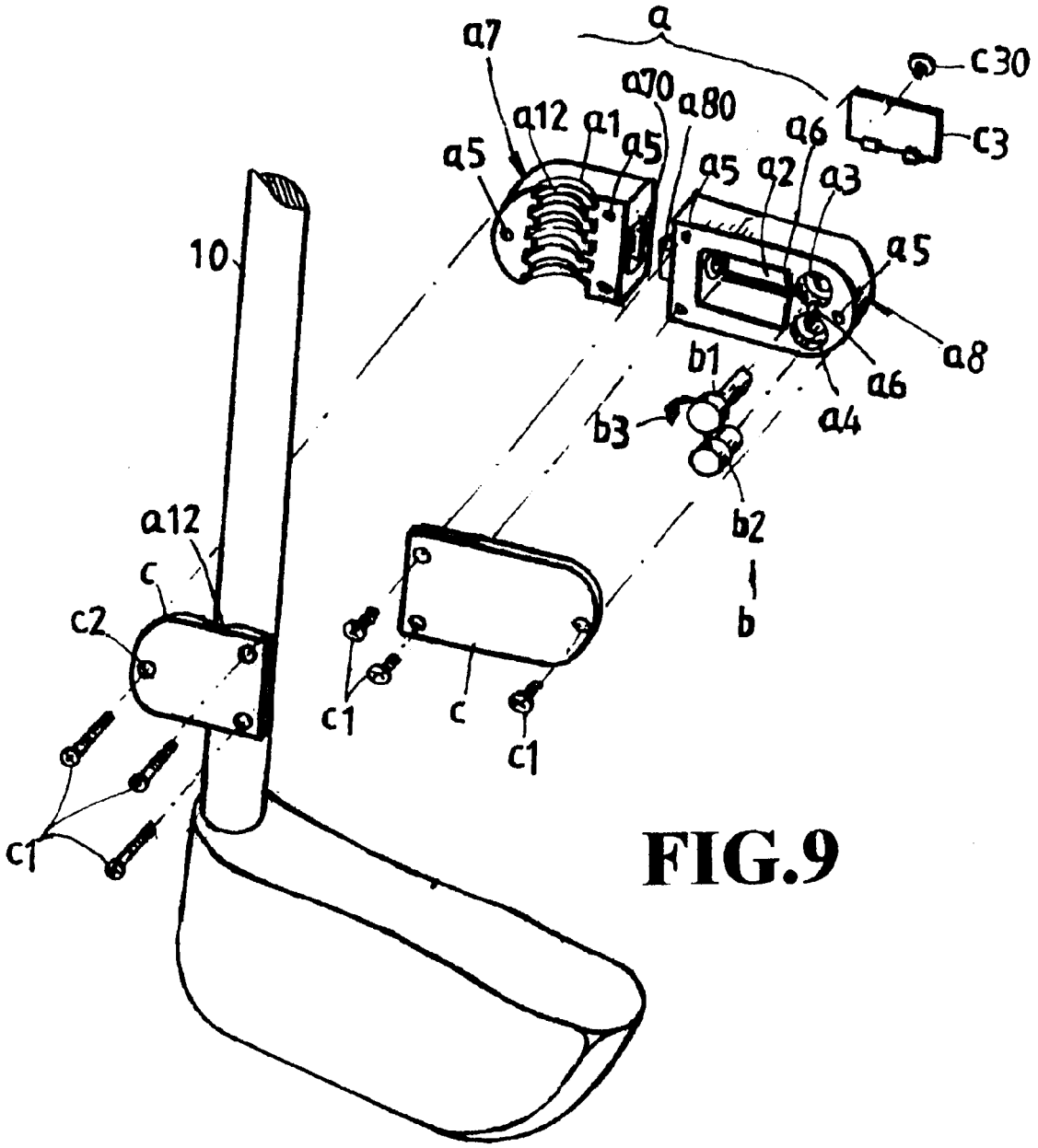
FIG. 9 shows another preferred embodiment of the present invention.
Figure 10:
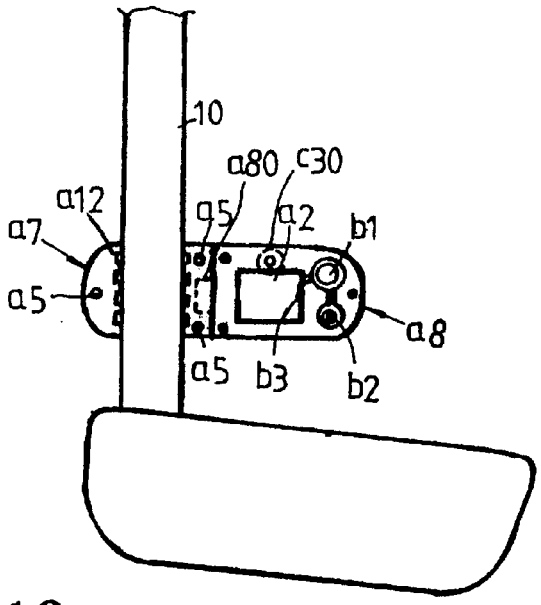
FIG. 10 shows the planar diagram of the assembly as illustrated in FIG. 9.
Figure 11:
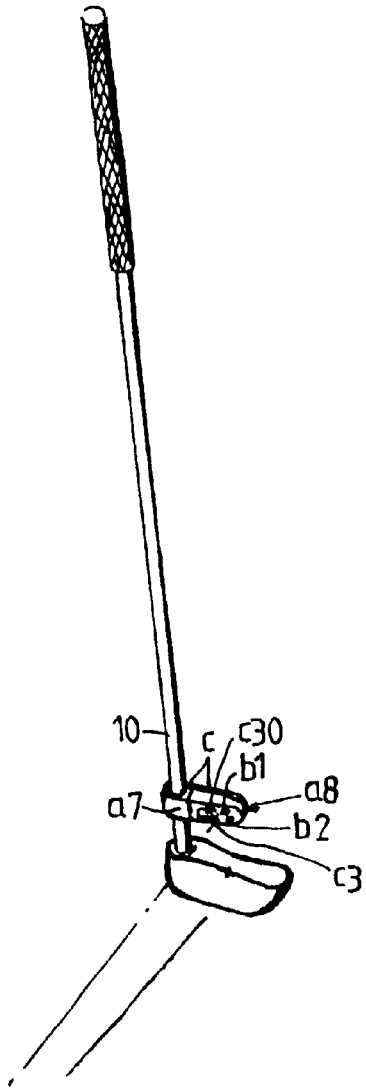
FIG. 11 shows the illustrative diagram of the preferred embodiment of the present invention as illustrated in FIG. 9.

Further, please refer to FIGS. 9 to 11 for explosive diagram, planar diagram of the assembly, and illustrative diagram of another preferred embodiment of the present invention. From the figures, it is known that besides the foregoing structure, it also divides the base (a) into a clipping body (a7) on the putter (10) and a base (a8) for accommodating battery, ON/OFF switch, and laser emitter; wherein the clipping body (a7) has a groove hole (a70) on one of its side, a plurality of transversal grooves (a12) above the groove (a1). After the groove (a1) with the transversal grooves (a12) are sheathed onto the putter (10), a plurality of fixing screws (c1) are used to fix the bottom casing (c) onto the back side of the clipping body (a7) such that the base (a7) does not need a rubber washer (a11) but still can be fixed securely onto the putter (10). The body (a8) corresponsive to the latching member (a80) is disposed on a lateral side of the groove hole (a70), such that the latching member (a80) can be stuck into or separated from the groove hole (a70), or the body (a8) and the base (a7) can be attached integrally or detached. In addition, the body (a8) has a mobile battery lid (c3) which can be fixed by the fixing screw (c30) by its edge. The fixing screws (c30) secures the mobile battery lid (a3) to prevent the mobile battery lid (a3) from being knocked off or loosened due to the vibration created during the play. A plurality of fixing screws (c1) are used to secure the bottom casing (c) to the back side of the body (a8), such that the battery, ON/OFF switch, and laser emitting device are secured into the battery accommodation cavity (a2), ON/OFF switch accommodating hole (a3) and laser emitter accommodating hole (a4); wherein the shape of the battery accommodation cavity (a2) could be circular, it could also be designed in square or rectangular shape to accommodate larger battery and enhance the time of application. The mobile battery lid (c3) can be designed into square or rectangular shape according to the shape of the battery accommodation cavity (a2) and a latch structure is used to latch the lid onto the body (a8) in order to cover the battery accommodation cavity (a2) and facilitate the battery replacement.

In view of the above description, it is known that the present invention has the following advantages:

1. It has less components which are in simpler shape and easy to assemble.
2. The component accommodations are concentrated on the same side of a single base, which facilitates the molding for mass production and thus lowers the cost.
3. Since it has less component and they are of simpler shape, therefore the size will definitely decrease quite a lot, and effectively reduce its weight.
4. The base is divided into clipping body that is specially used for securing to the clipping body of the putter, and the body for accommodating the battery, ON/OFF button, laser emitter. Therefore, it is easy to dissemble for storage, and reassemble for the use in the future.

In summation of the above description, the present invention herein enhances the performance of the conventional structure, which totally complies with the cost effective requirements, reduces the number of components, simplifies the shape for easy molding, effectively lowers the manufacturing cost, and reduces the volume. The present invention definitely can prevent the complicated molding, and the high manufacturing cost, and thus complies with the patent application requirements and is submitted to the Patent and Trademark Office for review and granting of the commensurate patent rights.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A laser aiming device on the club head of a golf putter, comprising: a base further comprising a laser emitting module being mounted to one bottom casing or two bottom casings by a plurality of buried head screws; wherein the laser emitting module further comprising a laser emitter being coupled to an ON/OFF switch and a conductive plate, and the base is integrally pressed or shaped as a whole; on the same side, a groove with substantially equal external diameter as that of the golf putter, a battery accommodation cavity, an accommodation switch, two different sized holes, and a plurality of screw holes are set thereby the battery accommodation cavity and the two different sized holes are coupled to a groove for being used by the wires of the accommodation switch and the laser emitter; a trapezoid hole being disposed on the back of the bottom casing corresponsive to the screw hole of the base; and when it is assembled, the conductive plate of the laser emitting module being placed into the battery accommodation cavity and the ON/OFF switch and laser emitter into the two different sized holes respectively according to the sequence of their sizes; and two pieces of mercury batteries being placed into the battery accommodation cavity, and a battery cover being used to seal the opening at the front side of the battery accommodation cavity in order to fix the mercury battery into the shaft of the golf club or use the groove to sheath a rubber washer onto the putter and then buried head screw being used for the mounting by passing it through the trapezoid hole and the screw hole such that the bottom casing, the golf putter, and the base are securely coupled together as a whole.

2. The laser aiming device on the club head of a golf putter as claimed in claim 1, wherein said base body and said bottom casing can be divided into a clipping body on the putter and a base for accommodating a battery, an ON/OFF switch, and a laser emitter; wherein the clipping body having a groove hole on one of its side, a plurality of transversal grooves above the groove; after the groove with the transversal grooves being sheathed onto the putter, a plurality of fixing screws are used to fix the bottom casing onto the back side of the clipping body such that the base does not need a rubber washer but still can be fixed securely onto the putter; the body corresponsive to the latching member is disposed on a lateral side of the groove hole, such that the latching member can be stuck into or separated from the groove hole, or the body and the base can be attached integrally or detached; in addition, the body has a mobile battery lid which can be fixed by the fixing screw by its edge; the fixing screws secures the mobile battery lid to prevent the mobile battery lid from being knocked off or loosened due to the vibration created during the play; a plurality of fixing screws are used to secure the bottom casing to the back side of the body, such that the battery, ON/OFF switch, and laser emitting device are secured into the battery accommodation cavity, ON/OFF switch accommodating hole and laser emitter accommodating hole; wherein the shape of the battery accommodation cavity could be circular, it could also be designed in square or rectangular shape to accommodate larger battery and enhance the time of application; the mobile battery lid can be designed into square or rectangular shape according to the shape of the battery accommodation cavity and a latch structure is used to latch the lid onto the body in order to cover the battery accommodation cavity and facilitate the battery replacement; said structure can be detached conveniently for storage and assembled again for the use in the future.

* * * * *